US010702053B2

(12) United States Patent
Tschol et al.

(10) Patent No.: US 10,702,053 B2
(45) **Date of Patent: *Jul. 7, 2020**

(54) HEAD FOR AN ORAL CARE IMPLEMENT, ORAL CARE IMPLEMENT AND METHOD FOR MANUFACTURING SUCH HEAD

(71) Applicant: The Gillette Company LLC, Boston, MA (US)

(72) Inventors: Armin Tschol, Frankfurt am Main (DE); Benedikt Heil, Eschborn (DE); Aycan Senturk Andersson, Frankfurt (DE); Stephanie Venzke, Wiesbaden (DE)

(73) Assignee: THE GILLETTE COMPANY LLC, Boston, MA (US)

( * ) Notice: Subject to any disclaimer, the term of this patent is extended or adjusted under 35 U.S.C. 154(b) by 42 days.

This patent is subject to a terminal disclaimer.

(21) Appl. No.: 15/939,176

(22) Filed: Mar. 28, 2018

(65) Prior Publication Data

US 2018/0279760 A1 Oct. 4, 2018

(30) Foreign Application Priority Data

Mar. 31, 2017 (EP) ..... 17164046

(51) Int. Cl.
*A46B 9/04* (2006.01)
*A46B 9/02* (2006.01)
(Continued)

(52) U.S. Cl.
CPC ..... *A46B 9/045* (2013.01); *A46B 9/025* (2013.01); *A46B 9/028* (2013.01); *A46B 9/04* (2013.01);
(Continued)

(58) Field of Classification Search
CPC ..... A46B 9/045; A46B 9/025; A46B 9/028; A46B 9/04; A46B 9/06; A46B 15/00;
(Continued)

(56) References Cited

U.S. PATENT DOCUMENTS 4,279,053 A 7/1981 Payne et al.
5,201,092 A * 4/1993 Colson ..... A46B 9/04 15/167.1

(Continued)

FOREIGN PATENT DOCUMENTS

WO WO9838889 9/1998
WO WO-9838889 A2 * 9/1998 ..... A46B 9/04

OTHER PUBLICATIONS

ISR PCT/US2018/025045 European Search Report with Opinion, dated May 25, 2018, 11 pages.

*Primary Examiner* — Weilun Lo
(74) *Attorney, Agent, or Firm* — Vladimir Vitenberg

(57) ABSTRACT

A head (14) for an oral care implement (10) has a mounting surface (20) with a proximal end (41) and a distal end (40), the head (14) comprising at least one tuft of a first type (16) and at least one tuft of a second type (18). The at least one tuft of the first type (16) comprises filaments having a substantially circular cross-sectional area extending in a plane perpendicular to the longitudinal axis and an end-rounded free end, and the at least one tuft of the second type (18) comprises flagged filaments having split free ends. The at least one tuft of the first type (16) is arranged at the distal end (40), and the at least one tuft of the second type (18) is arranged at the proximal end (41) of the head (14).

13 Claims, 4 Drawing Sheets

(51) Int. Cl.
*A46B 15/00* (2006.01)
*A46D 1/00* (2006.01)

(52) U.S. Cl.
CPC ..... *A46B 15/00* (2013.01); *A46D 1/0292* (2013.01); *A46B 2200/1066* (2013.01)

(58) Field of Classification Search
CPC ..... A46B 2200/1066; A46D 1/0238; A46D 1/0284; A46D 1/0292
See application file for complete search history.

(56) References Cited

U.S. PATENT DOCUMENTS 6,203,320 B1 * 3/2001 Williams ..... A46B 11/063 132/308
6,496,999 B1 * 12/2002 Gleason ..... A46B 9/045 15/167.1
6,886,207 B1 * 5/2005 Solanki ..... A46B 9/028 15/110
7,137,166 B1 11/2006 Kraemer
8,789,228 B2 7/2014 Driesen et al.
2002/0004964 A1 * 1/2002 Luchino ..... A46B 3/00 15/167.1
2002/0034636 A1 * 3/2002 Weihrauch ..... A46B 15/001 428/373
2009/0094770 A1 * 4/2009 Zoschke ..... A46D 1/00 15/207.2
2010/0223745 A1 * 9/2010 Kraemer ..... A46B 9/02 15/167.1
2015/0257520 A1 * 9/2015 Stoerkel ..... A46B 9/04 15/104.93
2015/0289638 A1 * 10/2015 Jungnickel ..... A46B 9/04 15/167.1
2017/0127818 A1 * 5/2017 Wagstaff ..... A46D 1/0276
2017/0164724 A1 * 6/2017 Moskovich ..... A46B 3/005
2018/0206627 A1 * 7/2018 Xi ..... A46D 1/0238
2018/0279757 A1 10/2018 Tschol et al.
2018/0279758 A1 10/2018 Tschol et al.
2018/0279759 A1 10/2018 Tschol et al.

* cited by examiner

HEAD FOR AN ORAL CARE IMPLEMENT, ORAL CARE IMPLEMENT AND METHOD FOR MANUFACTURING SUCH HEAD

FIELD OF THE INVENTION

The present disclosure is concerned with a head for an oral care implement, the head having a mounting surface comprising at least one tuft of a first type and at least one tuft of a second type comprising a plurality of flagged filaments. The present disclosure is further concerned with an oral care implement comprising such head, and a method for manufacturing said head.

BACKGROUND OF THE INVENTION

Tufts composed of a plurality of filaments for oral care implements, like manual and powered toothbrushes, are well known in the art. Generally, the tufts are attached to a bristle carrier or mounting surface of a head intended for insertion into a user's oral cavity. A grip handle is usually attached to the head, which handle is held by the user during brushing. The head is either permanently connected or repeatedly attachable to and detachable from the handle.

In order to clean teeth effectively, appropriate contact pressure has to be provided between the free ends of the filaments and the teeth. Generally, the contact pressure depends on the bending stiffness and the displacement of the filaments, while the bending stiffness of a single filament depends on its length and cross sectional area. Usually, filaments with greater length show lower bending stiffness as compared to shorter filaments. However, relatively thin filaments tend to flex away easily and the relatively low bending stiffness results in reduced plaque removal efficiency on teeth surfaces, as well as in less interdental penetrations properties and cleaning performance. In order to compensate said reduction in bending stiffness of longer filaments, the size of the cross sectional area of a filament could be increased. However, relatively thick filaments may create an unpleasant brushing sensation and tend to injure the gums in the oral cavity.

Further, tuft patterns composed of filaments having tapered or flagged free ends are also known in the art. Such filaments should improve cleaning properties of oral care implements during normal use. In particular, the relatively thin ends of the filaments should provide improved interdental penetration in the interproximal areas during a brushing process to improve removal of plaque and other residuals in these hard to reach areas.

While these toothbrushes may clean interdental areas adequately, they are generally not as well suited to provide adequate removal of plaque and debris from the buccal and lingual surface via a scrubbing and polishing action since its bending stiffness is not sufficiently high.

In order to achieve and preserve good oral health, and to prevent gingivitis, it is important to clean both, substantially flat tooth surface via a scrubbing and polishing action, as well as along the gum line and in interdental areas, in particular in the region of the back molars. Further gaps between teeth and periodontium, the so called gingival groove has to be thoroughly cleaned. It is known that a lack of good removal of plaque in the gingival groove can cause gingivitis, i.e. inflammation of the gum tissue. Additionally, standard tufts do not provide sufficient capillary effects to remove plaque and debris from the teeth and gums during brushing. However, in order to achieve good cleaning results, the plaque must be reached by the tufts/filaments, then the plaque must be disrupted and, finally, taken away. Further, the tufts shall provide good sensory feeling on the gums during brushing.

Additionally, the mechanical stress occurring within flagged or tapered filaments during a brushing process leads to higher stress in the tips of the filaments as compared to circular-shaped filaments. This means, in tufts having the same overall stiffness, flagged or tapered filaments have to bear higher maximum stress values as compared to circular-shaped filaments. This increased stress in the individual filaments can lead to an increased wear behavior during usage. This wear is characterized by an increased splay of the tuft which leads to less consumer acceptance.

It is an object of the present disclosure to provide a head for an oral care implement which overcomes at least one of the above-mentioned drawbacks. It is also an object of the present disclosure to provide an oral care implement comprising such head, and a method for manufacturing said head.

SUMMARY OF THE INVENTION

In accordance with one aspect, a head for an oral care implement is provided, the head having a mounting surface with a proximal end and a distal end, the head comprising at least one tuft of a first type and at least one tuft of a second type, the at least one tuft of the first type comprising filaments having a substantially circular cross-sectional area extending in a plane perpendicular to the longitudinal axis and an end-rounded free end, and the at least one tuft of the second type comprising flagged filaments having split free ends, wherein the at least one tuft of the first type is arranged at the distal end, and the at least one tuft of the second type is arranged at the proximal end.

In accordance with one aspect an oral care implement is provided that comprises such head.

In accordance with one aspect a method for manufacturing a head for an oral care implement is provided, the method comprising the following steps:

- providing a head comprising a mounting surface with tuft receiving holes therein,
- inserting the at least one tuft of the first type into one of the tuft holes and anchoring said tuft with an anchor wire in one stapling step,
- end-rounding the filaments of the tuft of the first type,
- inserting the at least one tuft of the second type into one of the tuft holes and anchoring said tuft with an anchor wire in another stapling step,
- flagging the filaments of the tuft of the second type.

BRIEF DESCRIPTION OF THE DRAWINGS

The invention is described in more detail below with reference to various embodiments and figures, wherein.

DETAILED DESCRIPTION OF THE INVENTION

Figure 1:
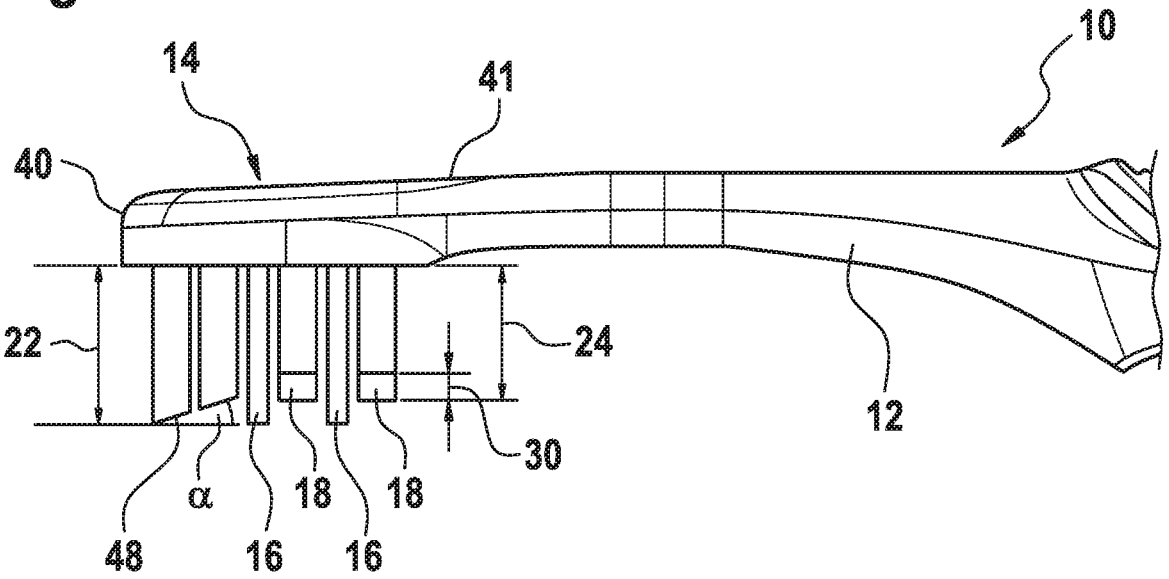
FIG. 1 shows a schematic side view of an example embodiment of an oral care implement comprising a head according to the present disclosure.

The head for an oral care implement according to the present disclosure comprises a mounting surface on which at least one tuft of a first type and at least one tuft of a second type are fixed/tufted.

The at least one tuft of the first type comprises a plurality of filaments having a longitudinal axis and a substantially circular shaped cross-sectional area extending in a plane substantially perpendicular to the longitudinal axis. The free ends of these filaments are end-rounded. The longitudinal axis of a filament or tuft is defined by the main extension of the filament or tuft, respectively. In the following, the extension of the filament/tuft along its longitudinal axis may also be referred to as the "longitudinal extension of the filament/tuft".

The at least one tuft of the second type comprises flagged filaments having split free ends. Such filaments may deliver liquids and toothpaste to the tooth surfaces more uniformly. The split free ends provide an increased surface area at the free ends of the filaments. Thus, liquids and toothpaste can be captured more easily which results in improved foam generation during a brushing process. At the same time the relatively small diameter of the flags/split ends improves uniform and smooth distribution of toothpaste which provides improved gentle and thorough polishing effects on substantially flat teeth surfaces as well as in the transition zone between the teeth and the gums. Due to the lower stiffness of the filament tips, the brush performs a softer cleaning action, thereby preventing the gums from getting damaged. Further, due to capillary effects plaque and tartare can be picked up more easily thereby preventing that the plaque/tartare is pushed in small gaps between the teeth and the gums during brushing. The risk of gingivitis can be significantly reduced. Further, toothpaste can be delivered onto the teeth/gum surface in a better manner resulting in improved cleaning performance.

The head has a distal end and a proximal end, being opposite the distal end and closest to a handle. The at least one tuft of the second type is arranged at the proximal end of the head, while the at least one tuft of the first type is attached at the distal end/portion of the head. Such tuft arrangement may allow good access to hard to reach areas in the mouth with the relatively stiff standard filaments, i.e. with the non-flagged filaments, to provide thorough cleansing in these areas, while easy accessible flat surfaces in the buccal and lingual regions can be polished thoroughly via the at least one tuft of the second type. The higher bending stiffness allows the filaments of the tuft of the first type to enter interproximal areas more easily, in particular in the region of the back molars which usually are not easy to reach. At the same time the tuft composed of the flagged filaments can provide thorough polishing effects on substantially flat tooth and gum surfaces in the areas in the mouth which are easier accessible.

Such effects may be further improved if the head comprises a plurality of rows of tufts arranged perpendicular to a longitudinal axis of the head, wherein a first row of tufts of the second type is arranged at the proximal end of the head, while a second row of tufts of the first type is arranged at the distal portion of the head. These effects may be even further improved by a head that comprises at least two rows of tufts of the first type and at least two rows of tufts of the second type, wherein the rows of tufts of the first type and second type are arranged in an alternating manner (cf. test results shown in FIGS. 4 and 5).

The tuft of the first type may be longer than the tuft of the second type. In other words, the at least one tuft of the first type may have a length extension along a longitudinal axis being longer than the length extension of the at least one tuft of the second type. In the context of this disclosure, the length of a tuft is defined by the extension of the tuft measured from its lower end being secured at a mounting surface/bristle carrier of the head to its upper free/loose end.

The difference in length of the at least one tuft of the first type and the at least one tuft of the second type may allow good penetration properties of the filaments of the longer tuft into interdental spaces whereas the filaments of the shorter tuft may clean the buccal, lingual and occlusal surfaces of the teeth adequately by a scrubbing and polishing brushing action. The at least one tuft of the second type may provide an adequate scrubbing and polishing effect and is specialized for cleaning the flat and easily accessible surfaces of the teeth. A head for an oral care implement is provided that may remove plaque and other residues more effectively both, on substantially flat surfaces as well as in interdental spaces. The tufts of the first and second type work synergistically together.

Further, usually flagged filaments show increased filament wear with use and they may wear out quickly, which may result in negative consumer acceptance of the overall brush as such brushes may be seen as low quality brushes. However, the tuft of the longer length may provide the tuft comprising flagged filaments with increased stability in order to prevent said tuft from extensive splaying. Consequently, the longer tuft can significantly improve the wear and brushing behavior over a relatively long period of time. Wear appearance of the tuft is significantly improved, while providing increased tooth cleaning efficiency. Brushes which look less used after brushing, in particular over a longer period of time, provide higher consumer acceptance.

A difference in length between the at least one tuft of the first type and the at least one tuft of the second type may be about 1 mm to about 2 mm, or about 1.5 mm, or about 2 mm. Test results revealed that the difference in length between the longer and the shorter tufts is critical for interdental penetration and the overall cleaning capabilities. In case the length difference is too small the longer tooth cleaning element may not penetrate deeply enough into the interproximal areas to provide sufficient plaque removal. However, a length difference being too large may prevent the shorter tooth cleaning element from touching, polishing and cleaning the buccal, lingual and occlusal surfaces of the teeth. Surprisingly, it was found out that a length difference of about 1.5 mm or about 2 mm provides both, improved interdental cleaning properties by means of the longer tuft and good cleaning performance on the buccal, lingual and occlusal surfaces of the teeth by means of the shorter tuft.

The flagged filaments (FIGS. 7, 9, 10) may be trilocular filaments 18a (FIG. 9) comprising three voids or tetralocular filaments 18b (FIG. 10) comprising four voids. The voids extend along the longitudinal axis of the filament. Trilocular and tetralocular filaments 18a, 18b (FIGS. 9, 10, respectively) may further improve trapping liquids and toothpaste in the open voids which may results in even improved brushing performance. Further, trilocular and tetralocular filaments can be easily processed to create flagged/split free ends. The voids extending along the longitudinal extension of the filaments may also provide reduced bending stiffness to provide gentler/softer brushing effects, e.g. to protect sensitive gums.

Figure 6:
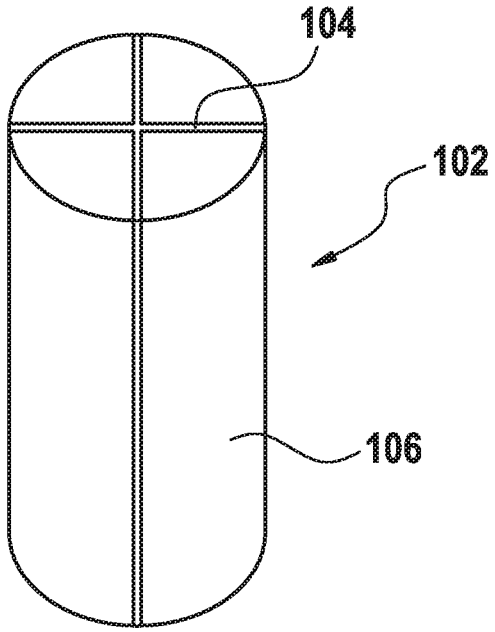
FIG. 6 shows an exemplary coextruded filament before flagging.
Figure 13:
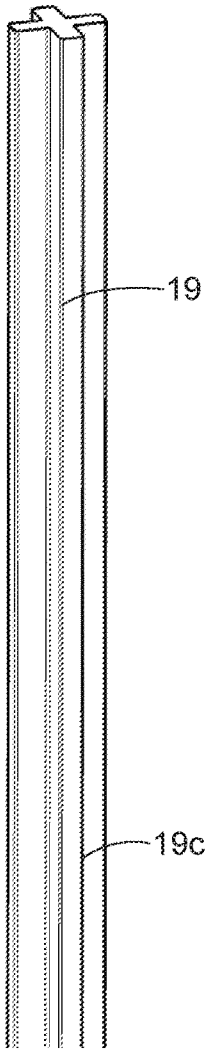
FIG. 13 shows an example cross-shaped filament.
Figure 12:
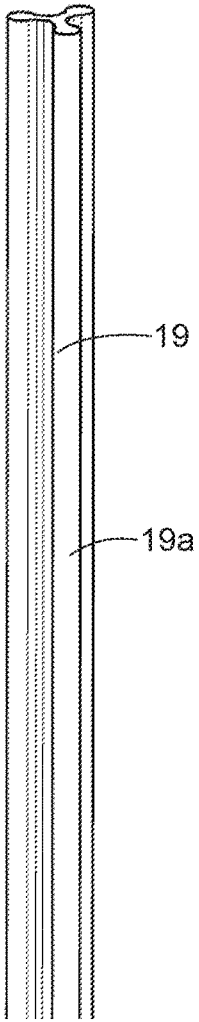
FIG. 12 shows an example trilobal filament.
Figure 11:
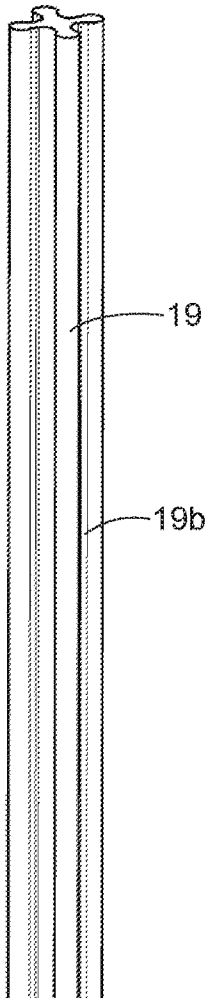
FIG. 11 shows an example tetralobal filament.

The flagged filaments may be monofilaments being extruded into a substantially round shape, i.e. such filaments may have a substantially circular cross-sectional area (FIG. 6). However, the shape can be altered to provide specific performance and cost attributes. For example, the flagged filaments may be made from non-round filaments 19 (FIGS. 11, 12, 13), such as, e.g., filaments having a trilobal cross-sectional area (FIG. 12), filaments having tetralobal cross-sectional area 19b (FIG. 11), and filaments having a cross-shaped cross-sectional area 19c (FIG. 13).

A cross-shaped cross-sectional area may have four projections and four channels, the projections and channels being arranged in an alternating manner. Each channel may have a concave curvature formed by neighboring and converging projections. The concave curvature may have a radius, wherein the radius of the concave curvature of the channel is within a range from about 0.025 mm to about 0.10 mm, or from about 0.03 mm to about 0.08 mm, or from about 0.04 mm to about 0.06 mm. The cross-sectional area of the filament may have an outer diameter within a range from about 0.15 mm to about 0.40 mm, or from about 0.19 mm to about 0.38 mm, or from about 0.22 mm to about 0.35 mm, or from about 0.24 mm to about 0.31 mm. The ratio of the outer diameter to the radius of the concave curvature of the channel may be within a range from about 2.5 to about 12, or from about 2.7 to about 9.

Such filament configuration enables the provision of a tuft with a relatively low packing factor within a range from about 40% to about 55%, or from about 40% to about 49% or about 45%, while providing a relatively dense and uniform brushing surface due to the high amount of flags/split ends.

The packing factor of regular tufts known in the art and comprising circular shaped filaments is from about 70% to about 80%. In the context of this disclosure the term "packing factor" is defined as the sum total of the transverse cross-sectional areas of the filaments in the tuft hole divided by the transverse cross-sectional area of the tuft hole. In embodiments where anchors, such as staples, are used to mount the tuft within the tuft hole, the area of the anchoring means is excluded from the transverse cross-sectional area of the tuft hole.

A low packing factor of about 40% to about 55%, or from about 45% to about 49% opens up a specific void volume within the tuft while the filaments have still contact to each other along a portion of the outer lateral surface. The void volume may deliver even more toothpaste to the tooth brushing process, and the toothpaste can interact with the teeth for a longer period of time which contributes to improved tooth brushing effects. In addition, the void volume, i.e. the space between filaments, enables increased uptake of loosened plaque due to improved capillary action. In other words, such low packing factor may result in more dentifrice/toothpaste retaining at/adhering to the filaments for a longer period of time during a tooth brushing process. Further, the lower tuft density may avoid that dentifrice spread away which may result in an improved overall brushing process. Toothpaste can be better received in the channels and, upon cleaning contact with the teeth, directly delivered, whereby a greater polishing effect is achieved, which is desirable, in particular for removal of tooth discoloration.

In other words, a relatively low packing factor within a range from about 40% to about 55%, or from about 45% to about 49%, or about 49% may provide improved brushing effectiveness, i.e. better removal of plaque and debris from the teeth's surface and gums due to improved capillary effects. These capillary effects may enable the dentifrice to flow towards the tip/free end of the filaments and, thus, may make the dentifrice better available to the teeth and gums during brushing. At the same time uptake of plaque and debris away from the teeth and gum surfaces is further improved.

Further, due to the cross-shaped geometry of the filament, each single filament is stiffer than a circular-shaped filament, when made of the same amount of material. The filament's resistance to bending and buckling is increased as compared to standard circular-shaped filaments made of the same amount of material. However, due to the relatively low packing factor the stiffness of the overall tuft made of cross-shaped filaments is reduced as compared to a tuft of circular-shaped filaments made of the same amount of material. Surprisingly, it has been found out that according to both, clinical and sensory/consumer testing, a tuft according to the present disclosure provides improved sensory experience, i.e. a softer feeling within the mouth during brushing, while providing increased cleaning efficiency. The shorter tuft is effective for cleaning the flat surfaces via a buckling and scrubbing motion. This effect may be reinforced due to the longer tuft which mainly performs a bending motion during a brushing process. The longer tuft provide improved interdental cleaning properties via bending against teeth and buckling when the brushing direction changes.

The at least one tuft of the first type and the at least one tuft of the second type have each a cross-sectional shape, e.g. circular, and the cross-sectional area of the tuft of the first type may be smaller than the cross-sectional area of the tuft of the second type. The at least one tuft of the first type may have a diameter of about 1 mm to about 2 mm, or about 1.4 mm, while the at least one tuft of the second type may have a diameter of about 2 mm to about 3 mm, or about 2.8 mm. Such tuft combination may provide both, further improved interdental penetration properties of the tuft of the first type and scrubbing effects of the tuft of the second type. The thinner tuft(s) can better enter interproximal areas and reach hard to reach areas, in particular in the region of the back molars, more easily. The bigger tuft(s) comprising the flagged filaments may provide a larger cleaning surface to polish substantially flat surfaces more efficiently. Thus, superior cleaning properties may be achieved.

The flagged filaments may have a cross-sectional area extending in a plane perpendicular to the longitudinal axis, and the diameter of the cross-sectional area may be about 4 mil (0.1 mm) to about 10 mil (0.25 mm), or about 5 mil (0.13 mm) to about 7 mil (0.18 mm), or about 6 mil (0.15 mm). Further, the flagged filaments may be split over a length extension of about 0.5 mm to about 5 mm, or about 3 mm to about 4 mm, or about 2 mm, measured from the free end of the filaments. Surprisingly, it was found out, that flagged filaments having a diameter of about 6 mil and a split portion of about 2 mm provide soft, but yet brushing and polishing effects.

The filaments of the tufts of the first and/or second type may be made of polyamide, e.g. nylon, with or without an abrasive such as kaolin clay, polybutylene terephthalate (PBT) with or without an abrasive such as kaolin clay and/or of polyamide indicator material, e.g. nylon indicator material, colored at the outer surface. The coloring on the polyamide indicator material may be slowly worn away as the filament is used over time to indicate the extent to which the filament is worn.

The filaments of the tufts of the first and/or second type may be made of coextruded material and, thus, may comprise at least two segments of different materials. At least one segment may comprise a thermoplastic elastomer material (TPE) and at least one segment may comprise polyamide, e.g. nylon, with or without an abrasive such as kaolin clay, polybutylene terephthalate (PBT) with or without an abrasive such as kaolin clay or a polyamide indicator material, e.g. a nylon indicator material, colored at the outer surface. These at least two segments may be arranged in a side-by-side structure or in a core-sheath structure which may result in reduced stiffness of the overall filament. A core-sheath structure with an inner/core segment comprising a harder material, e.g. polyamide or PBT, and with an outer/sheath segment surrounding the core segment and comprising a softer material, e.g. TPE, may provide the filament with a relatively soft outer lateral surface which may result in gentle cleaning properties.

The filaments of the tufts of the first and/or second type may comprise a component selected from fluoride, zinc, strontium salts, flavor, silica, pyrophosphate, hydrogen peroxide, potassium nitrate or combinations thereof. For example, fluoride may provide a mineralization effect and, thus, may prevent tooth decay. Zinc may strengthen the immune system of the user. Hydrogen peroxide may bleach/whiten the teeth. Silica may have an abrasive effect to remove dental plaque and debris more effectively. Pyrophosphate may inhibit the formation of new plaque, tartar and dental calculus along the gum line. Filaments, comprising pyrophosphate may offer lasting protection against inflammations of the gums and mucous membrane of the mouth.

At least one of the components listed above may be coated onto a sheath, i.e. onto an outer segment of a filament. In other words, at least some of the filaments of the tuft(s) may comprise a core-sheath structure wherein the inner/core segment may comprise TPE, polyamide or PBT, and the outer/sheath segment may comprise at least one of the components listed above. Such core-sheath structure may make the component(s) directly available to the teeth in a relatively high concentration, i.e. the component(s) may be in direct contact with the teeth during brushing.

Alternatively, at least one of the components listed above may be co-extruded with TPE, polyamide, e.g. nylon, and/or PBT. Such embodiments may make the component(s) gradually available to the teeth when the filament material is slowly worn away during use.

The oral care implement according to the present disclosure may be a toothbrush comprising a handle and a head. The head extends from the handle and may be either repeatedly attachable to and detachable from the handle, or the head may be non-detachably connected to the handle. The toothbrush may be an electrical or a manual toothbrush.

A head for an oral care implement in accordance with the present disclosure comprises a mounting surface or bristle carrier being provided with tuft holes, e.g. blind-end bores. Tufts according to the present disclosure may be fixed/anchored in said tuft holes by a stapling process/anchor tufting method. This means, that the filaments of the tufts are bent/folded around an anchor, e.g. an anchor wire or anchor plate, for example made of metal, in a substantially U-shaped manner. The filaments together with the anchor are pushed into the tuft hole so that the anchor penetrates into opposing side walls of the tuft hole thereby anchoring/fixing/fastening the filaments to the bristle carrier. The anchor may be fixed in opposing side walls by positive and frictional engagement. In case the tuft hole is a blind-end bore, the anchor holds the filaments against a bottom of the bore. In other words, the anchor may lie over the U-shaped bend in a substantially perpendicular manner. Since the filaments of the tuft are bent around the anchor in a substantially U-shaped configuration, a first limb and a second limb of each filament extend from the bristle carrier in a filament direction. Filament types which can be used/are suitable for usage in a stapling process are also called "two-sided filaments". Heads for oral care implements which are manufactured by a stapling process can be provided in a relatively low-cost and time-efficient manner.

A method for manufacturing a head for an oral care implement may comprise the following steps:

- providing a head comprising a mounting surface with tuft receiving holes therein,
- inserting the at least one tuft of the first type into one of the tuft holes and anchoring said tuft with an anchor wire in a first stapling step,
- end-rounding the filaments of the tuft of the first type,
- inserting the at least one tuft of the second type into one of the tuft holes and anchoring said tuft with an anchor wire in a second stapling step,
- flagging the filaments of the tuft of the second type.

The first stapling step may be performed before the second stapling step. However, a reverse stapling process may also be suitable in which the second stapling step is performed before the first stapling step.

Alternatively, the tufts may be attached/secured to the head by means of a hot tufting process. One method of manufacturing the head of an oral care implement may comprise the following steps: Firstly, the tufts may be formed by providing a desired amount of filaments according to the present disclosure. Secondly, the tufts may be placed into a mold cavity so that ends of the filaments which are supposed to be attached to the head extend into said cavity. Thirdly, the head or an oral care implement body comprising the head and the handle may be formed around the ends of the filaments extending into the mold cavity by an injection molding process, thereby anchoring the tufts in the head. Alternatively, the tufts may be anchored by forming a first part of the head—a so called "sealplate"—around the ends of the filaments extending into the mold cavity by an injection molding process before the remaining part of the oral care implement may be formed. Before starting the injection molding process, the ends of the at least one tuft extending into the mold cavity may be optionally melted or fusion-bonded to join the filaments together in a fused mass or ball so that the fused masses or balls are located within the cavity. The tufts may be held in the mold cavity by a mold bar having blind holes that correspond to the desired position of the tuft on the finished head of the oral care implement. In other words, the filaments of the tufts attached to the head by means of a hot tufting process may be not doubled over a middle portion along their length and may be not mounted in the head by using an anchor/staple. The tufts may be mounted on the head by means of an anchor-free tufting process. A hot tufting manufacturing process allows for complex tuft geometries. For example, the tufts may have a specific topography/geometry at its free end, i.e. at its upper top surface, which may be shaped to optimally adapt to the teeth's contour and to further enhance interdental penetration. For example, the topography may be chamfered or rounded in one or two directions pointed or may be formed linear, concave or convex.

The following is a non-limiting discussion of example embodiments of oral care implements and parts thereof in accordance with the present disclosure, where reference to the Figures is made.

Figure 2:
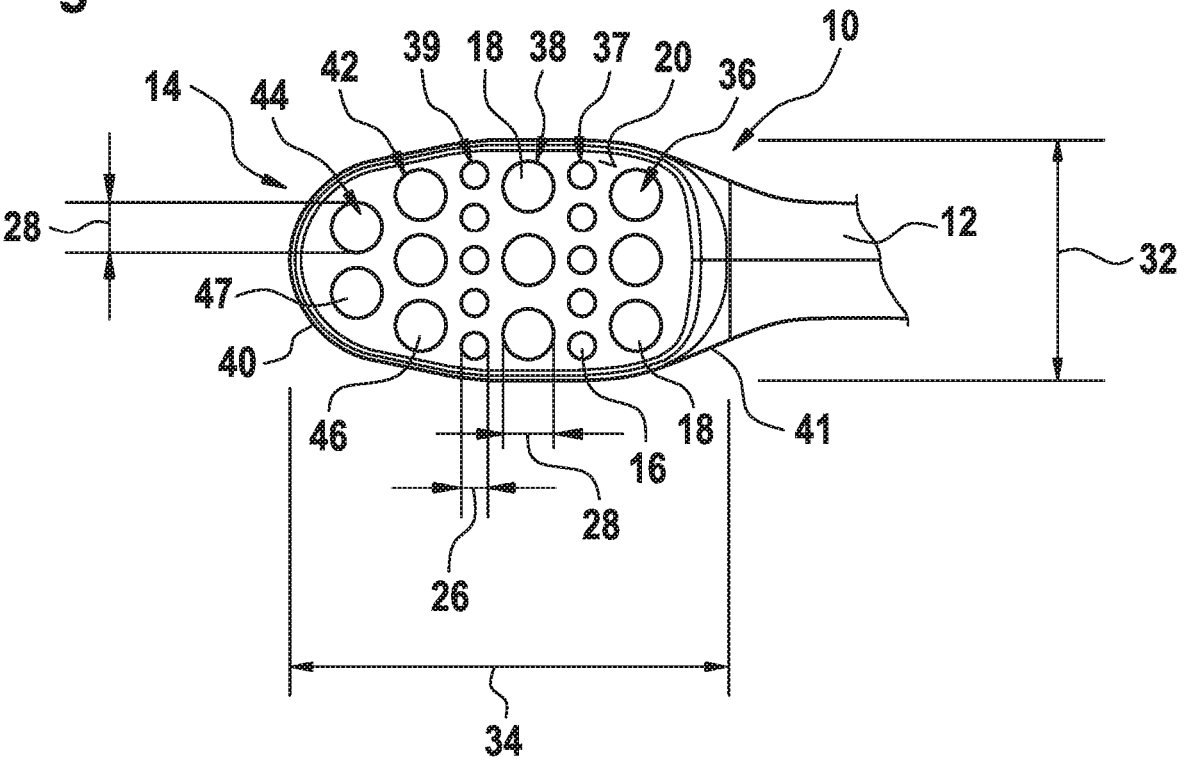
FIG. 2 shows a schematic top-down view of the embodiment of FIG. 1.
Figure 3:
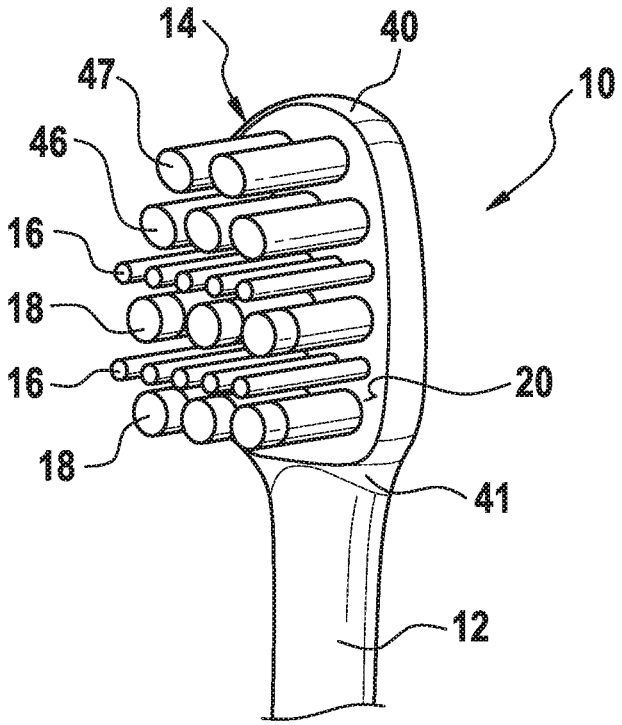
FIG. 3 shows a schematic perspective view of the embodiment of FIG. 1.

FIG. 1 shows a schematic side view of an example embodiment of an oral care implement 10 which could be a manual or an electrical toothbrush 10 comprising a handle 12 and a head 14 extending from the handle 12 in a longitudinal direction. The respective top-down view of said oral care implement 10 is shown in FIG. 2, while a perspective view is shown in FIG. 3.

Figure 8:
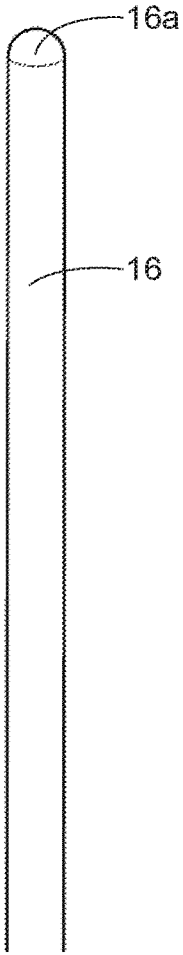
FIG. 8 shows an example filaments having a substantially circular cross-sectional area and an end-rounded free end.

The head 14 has a proximal end 41 close to the handle 12 and a distal end 40 furthest away from the handle 12, i.e. opposite the proximal end 41. A plurality of tufts of a first type 16 comprising a plurality of circular-shaped filaments (FIG. 8), and a plurality of tufts of a second length 18 comprising a plurality of flagged filaments (FIGS. 7, 9, 10) having split free ends are attached to a mounting surface 20 of the head 14. The tufts 16 of the first type are longer as compared to the tufts 18 of the second length. The tufts 16, 18 may be secured/attached to the mounting surface 20 of the head 14 by means of a hot tufting or stapling process. Tufts 16, 18 extend from the mounting surface 20 in a substantially orthogonal manner.

Figure 10:
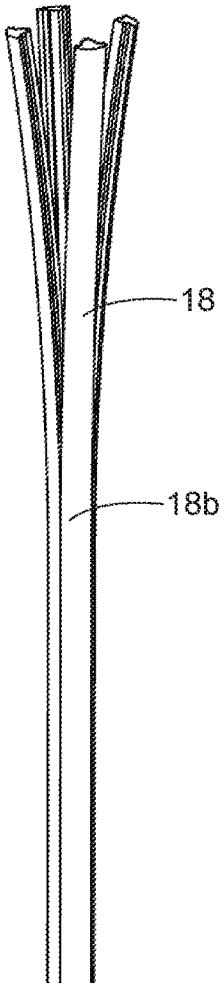
FIG. 10 shows an example tetralocular flagged filament.
Figure 9:
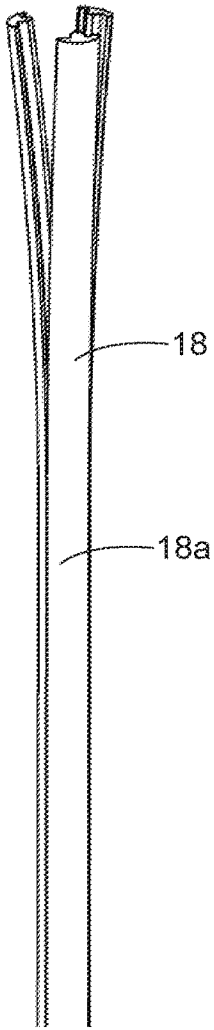
FIG. 9 show an example trilocular flagged filament.
Figure 7:
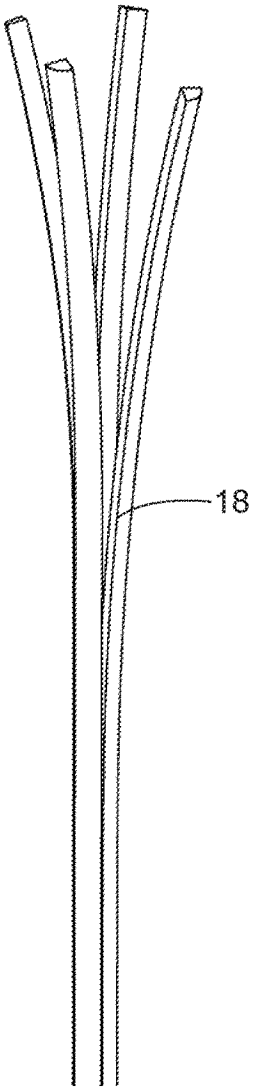
FIG. 7 shows an example coextruded filament after flagging.

The tufts of the first type 16 have a length extension 22 along a longitudinal axis of about 12 mm measured from the mounting surface 20 of the head 14. The length extension 24 of the tufts of the second type 18 is about 10 mm measured from the mounting surface 20. Both type of tufts 16, 18 have a substantially circular cross-sectional area. The diameter 26 of the longer tuft 16 is about 1.4 mm, while the diameter 28 of the shorter tuft 18 is about 2.8 mm. The flagged filaments of tuft 18 are split over a length extension 30 of about 2 mm measured from the free ends of the filaments 18 (FIGS. 7, 9, 10). The filaments with end-rounded ends 16a (FIG. 8) of the longer tufts 16 and the flagged filaments of the shorter tufts 18 have each a circular cross-sectional area having a diameter of about 6 mil (0.15 mm).

Tufts 16 and 18 are arranged in rows extending along the width 32 direction of the head 14, i.e. substantially perpendicular to the longitudinal direction 34 of the head 14. A first row 36 comprising three tufts of the second type 18 are attached to the mounting surface 20 at the proximal end 41 of the head 14, i.e. closest to the handle 12. Five further rows follow the first row 36 in the following order: A second row 37 comprising five tufts of the first type 16, a third row 38 comprising three tufts of the second type 18, and a fourth row 39 comprising five tufts of the first type 16. In other words, rows 36, 37, 38, 39 comprising either tufts of the first or the second type 16, 18 are attached to the mounting surface 20 in an alternating manner.

At the distal end 40 of the brush head 14, i.e. furthest away from the handle 12, there are two further rows of tufts 46, 47—a fifth row 42 and a sixth row 44—attached to the mounting surface 20. The sixth row 44 closest to the distal end 40 comprises two tufts 47 having a substantially circular cross sectional area with a diameter of about 2.8 mm. The fifth row 42 attached between the fourth row 39 and the sixth row 44 comprises three tufts having a substantially circular cross-sectional area with a diameter of about 2.8 mm. The filaments of the tufts 46, 47 have a substantially circular cross-sectional area with an end-rounded end and a diameter of about 6 mil (0.15 mm). The upper top surface 48 of tufts 46, 47 is chamfered in a direction towards the handle, i.e. towards the proximal end 41 of head 14 by an angle $\alpha$ of about 15.5° to about 16°. The longest length extension the filaments of tufts 47 is about 12 mm measured from the mounting surface 20, while the shortest length extension of the filaments of tufts 46 is about 10 mm measured from the mounting surface 20.

FIG. 6 shows a coextruded filament 102 (before flagging) comprising a core material 104 and a main material 106. The core material 104 is embedded in the main material 106 in a cross-shaped manner and extends along the longitudinal extension of the filament. Both materials have relatively low bonding properties between each other to allow easy splicing/flagging of the filament 102 in a typical flagging process, e.g. with a rounded knife.

Comparison Experiments

Robot Tests:

The brush head embodiment 14 of FIGS. 1 to 3 and a second example embodiment 100 of the invention were compared with a comparative example 140 with respect to its efficiency of plaque substitute removal on artificial teeth (typodonts).

The brush head embodiment 14 is the embodiment as described with respect to FIGS. 1 to 3. The flagged filaments of tufts 18 are tetralocular filaments.

The second example embodiment 100 of the invention is the same as disclosed in FIGS. 1 to 3, but the flagged filaments of tufts 18 are filaments as shown in FIG. 6, and the tuft 46 positioned in the middle of row 42 comprises these flagged filaments, too.

Comparative example 140 has the same tuft pattern with the same dimensions as example embodiments 14 and 100, but all filaments of all tufts are standard 6 mil filaments, i.e. each filament is a monofilament without any voids. The cross-sectional area is substantially circular having a diameter of about 6 mil.

Brushing tests were performed using a robot system KUKA 3 under the following conditions (cf. Table 1):

TABLE 1

| Product | program upper jaw | program lower jaw | force | power supply |
|---|---|---|---|---|
| All tested products | EO_INDI | EU_INDI | 3 N | no |
| total cleaning time | 60 s | 60 s | | |
| program version | 9.11.09 Eng | 9.11.09 Eng | | |
| SYSTEC speed | 60 | 60 | | |
| SYSTEC amplitude x/y | 20/0 | 20/0 | | |
| number of moves | 3 | 3 | | |
| Movement | | horizontal | | |
| used handle/mould | | No/no | | |

Figure 4:
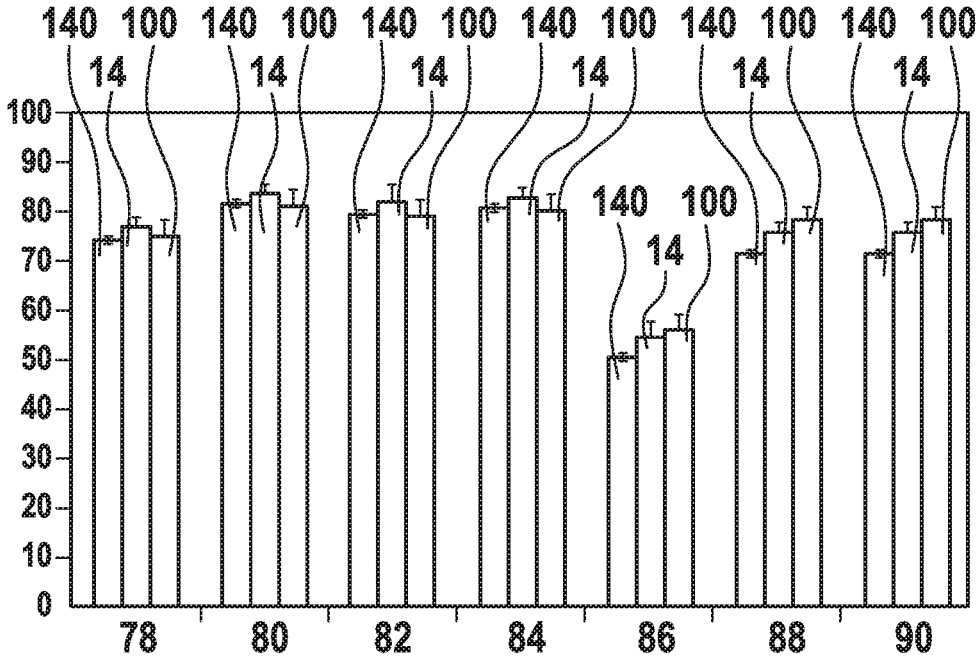
FIG. 4 shows a diagram in which brushing results of the embodiment of FIG. 1 and of another embodiment are compared with brushing results of a brush head according to a first comparative example embodiment.

FIG. 4 shows the amount of plaque substitute removal in % of example embodiment 14, the second example embodiment 100 and comparative example 140, each with respect to all tooth surfaces 78, buccal surfaces 80, lingual surfaces 82, lingual and buccal surfaces 84, occlusal surfaces 86, the gum line 88 and interdental surfaces 90.

FIG. 4 clearly shows that example embodiment 14 provides significant improved plaque removal properties with respect to all tooth surfaces 78, buccal surfaces 80, lingual surfaces 82, lingual and buccal surfaces 84, occlusal surfaces 86, the gum line 88 and interdental surfaces 90 as compared to comparative example 140. Also, example embodiment 100 provides significant improved plaque removal properties with respect to all tooth surfaces 78, occlusal surfaces 86, the gum line 88 and interdental surfaces 90 as compared to comparative example 140.

Further brushing tests were performed using the robot system KUKA 3 under the conditions as set forth in Table 1 above. The brush head embodiment 14 of FIGS. 1 to 3 was compared with two other comparative examples 200 and 300 with respect to its efficiency of plaque substitute removal on artificial teeth (typodonts).

Example embodiment 200 (Curaprox brush flat trim) comprises a plurality of tufts having all a substantially circular cross sectional area with a diameter of about 1.7 mm. Each tuft comprises a plurality of filaments having a diameter of 4 mil and a length extension of about 9 mm. The total number of filaments attached to the brush head is 5460.

Example embodiment 300 (Indicator brush 35 flat trim) comprises a plurality of tufts having all a substantially circular cross sectional area with a diameter of about 1.7 mm. Each tuft comprises a plurality of filaments having a diameter of 8 mil and a length extension of about 11 mm.

Figure 5:
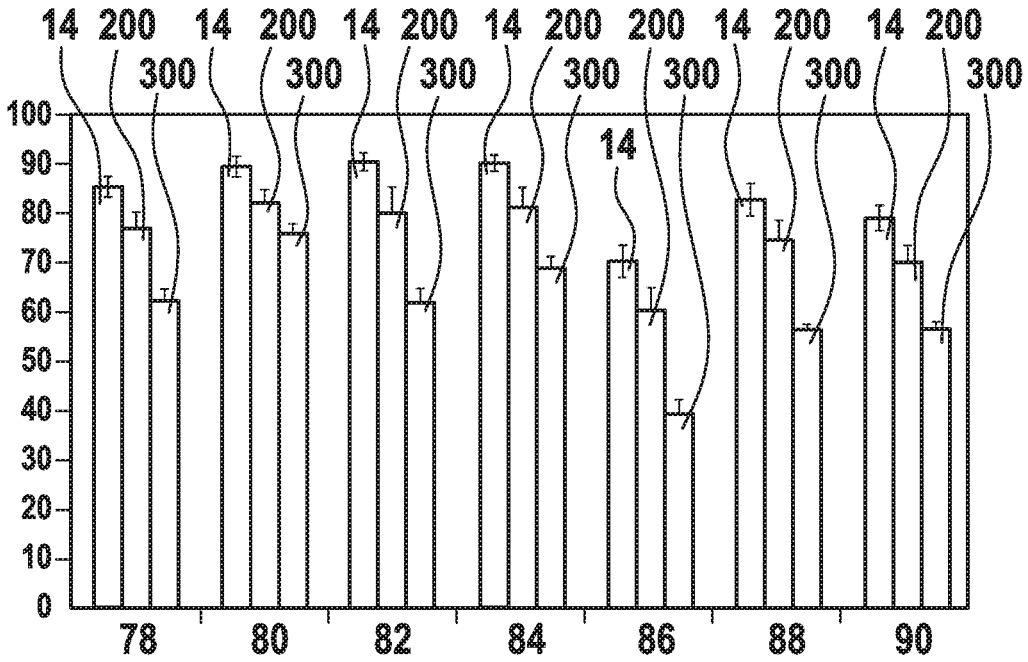
FIG. 5 shows a diagram in which brushing results of the embodiment of FIG. 1 are compared with brushing results of brush heads according to a second and a third comparative example embodiment.

FIG. 5 clearly shows that example embodiment 14 provides significant improved plaque removal properties with respect to all tooth surfaces 78, buccal surfaces 80, lingual surfaces 82, lingual and buccal surfaces 84, occlusal surfaces 86, the gum line 88 and interdental surfaces 90 as compared to comparative examples 200 and 300.

In the context of this disclosure, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A head for an oral care implement, the head having a mounting surface with a proximal end and a distal end, the head comprising at least one tuft of a first type and at least one tuft of a second type, the at least one tuft of the first type comprising filaments having a substantially circular cross-sectional area extending in a plane perpendicular to a longitudinal axis of the tuft and an end-rounded free end, and the at least one tuft of the second type comprising flagged filaments having split free ends, wherein the at least one tuft of the first type is arranged at the distal end, the at least one tuft of the second type is arranged at the proximal end, and wherein the tuft of the first type has a first length extension, and the tuft of the second type has a second length extension, the first length extension being longer than the second length extension measured from the mounting surface of the head along the longitudinal axis of the tuft.

2. A head according to claim 1, wherein the head comprises a plurality of rows of tufts arranged perpendicular to a longitudinal axis of the head, and the head comprises a first row of tufts of the second type being arranged at the proximal end of the head, and a second row of tufts of the first type.

3. A head according to claim 2, wherein the head comprises at least two rows of tufts of the first type and at least two rows of tufts of the second type, the rows of tufts of the first type and of the tufts of the second type being arranged in an alternating manner.

4. A head according to claim 1, wherein the first length extension is about 1 mm to about 2 mm, longer than the second length extension.

5. A head according to claim 1, wherein the flagged filaments are trilocular comprising three voids or tetralocular comprising four voids, the voids extending along the longitudinal axis of the filament.

6. A head according to claim 1, wherein the flagged filaments are trilocular comprising three voids or tetralocular comprising four voids, the voids extending along the longitudinal axis of the filament.

7. A head according to claim 1, wherein the flagged filaments have a cross-section area extending in a plane perpendicular to the longitudinal axis and the cross-sectional area has a shape being substantially circular, trilobal, tetralobal or cross-shaped.

8. A head according to claim 1, wherein the at least one tuft of the second type has a cross sectional area extending in a plane perpendicular to the longitudinal axis, and the cross-sectional area is larger than the cross-sectional area of the at least one tuft of the first type.

9. A head according to claim 1, wherein the flagged filaments have a cross-sectional area extending in a plane perpendicular to the longitudinal axis and the diameter of the cross-sectional area is about 4 mil (0.1 mm) to about 10 mil (0.25 mm).

10. A head according to claim 1, wherein the filaments of the at least one tuft of the second type are made from a coextruded material.

11. A head according to claim 1, wherein the flagged filaments are split over a length extension of about 0.5 mm to about 5 mm, measured from the free end of the filaments.

12. A head according to claim 1, wherein the head is manufactured by a stapling process.

13. An oral care implement comprising a head having a mounting surface with a proximal end and a distal end, the head comprising at least one tuft of a first type and at least one tuft of a second type, the at least one tuft of the first type comprising filaments having a substantially circular cross-sectional area extending in a plane perpendicular to a longitudinal axis of the tuft and an end-rounded free end, and the at least one tuft of the second type comprising flagged filaments having split free ends, wherein the at least one tuft of the first type is arranged at the distal end, and the at least one tuft of the second type is arranged at the proximal end, and wherein the tuft of the first type has a first length extension, and the tuft of the second type has a second length extension, the first length extension being longer than the second length extension as measured from the mounting surface of the head along the longitudinal axis of the tuft.

* * * * *